United States Patent [19]

Kobayashi

[11] 4,212,162

[45] Jul. 15, 1980

[54] CONSTANT COMBUSTION ENGINE

[75] Inventor: Akira Kobayashi, Nagoya, Japan

[73] Assignee: Kabushiki Kaisha Toyota Chuo Kenkyusho, Nagoya, Japan

[21] Appl. No.: 879,497

[22] Filed: Feb. 21, 1978

[30] Foreign Application Priority Data

Feb. 21, 1977 [JP] Japan ..... 52-18462

[51] Int. Cl.[2] ..... F02G 3/02

[52] U.S. Cl. ..... 60/39.63; 60/39.55; 123/3

[58] Field of Search ..... 123/3, 25 R, 25 E; 60/39.63, 39.6, 39.55

[56] References Cited

U.S. PATENT DOCUMENTS

| | | | |
|---|---|---|---|
| 1,302,582 | 5/1919 | Norman | 60/39.63 |
| 3,577,729 | 5/1971 | Warren | 60/39.63 |
| 3,932,987 | 1/1976 | Munzinger | 60/39.63 |
| 3,963,000 | 6/1976 | Kosaka et al. | 123/3 |
| 3,973,394 | 8/1976 | Girodin | 60/39.63 |
| 4,004,554 | 1/1977 | Kosaka et al. | 123/3 |
| 4,023,538 | 5/1977 | Harpman et al. | 123/3 |
| 4,036,181 | 7/1977 | Matovich | 123/3 |
| 4,050,419 | 9/1977 | Harpman et al. | 123/3 |
| 4,112,889 | 9/1978 | Harpman | 123/3 |
| 4,114,566 | 9/1978 | Harpman et al. | 123/3 |
| 4,125,090 | 11/1978 | Masunaga et al. | 123/3 |

*Primary Examiner*—Ira S. Lazarus

*Attorney, Agent, or Firm*—Cushman, Darby & Cushman

[57] ABSTRACT

A constant combustion engine wherein the air and the fuel are mixed at a predetermined air-fuel ratio, ignited and burned; the water is injected into the combustion products to generate the mixture of the combustion products and water vapor; and said mixture is charged as the working gases into a fluid motor. With a low grade fuel, a higher thermal efficiency may be obtained, and the emission of pollutants may be minimized.

10 Claims, 16 Drawing Figures

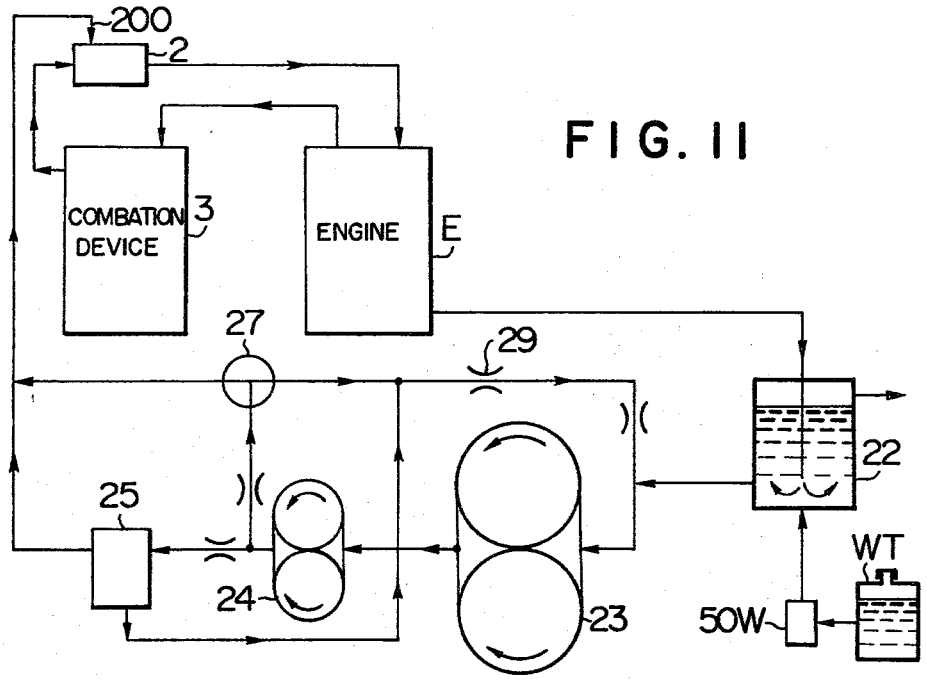
FIG. 11
FIG. 12
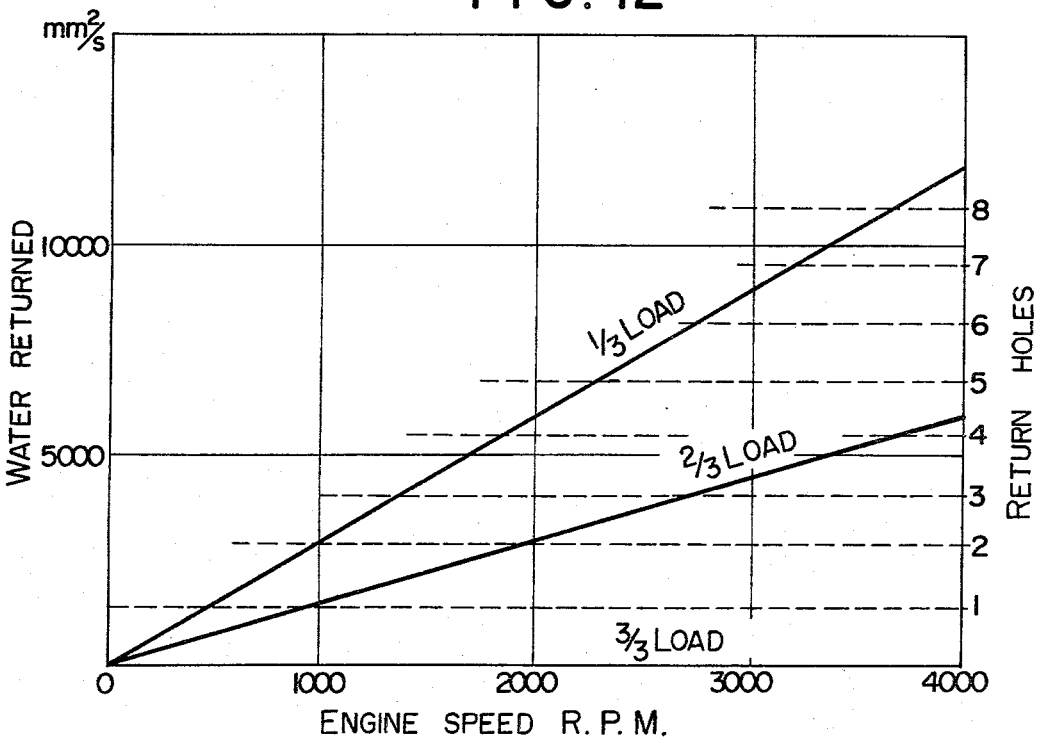

CONSTANT COMBUSTION ENGINE

BACKGROUND OF THE INVENTION

The present invention relates to a constant combustion engine.

In the conventional piston engines, the air-fuel mixture is ignited and burned within a very short time period of the power stroke so that the complete combustion cannot be completed or the misfiring tends to occur very frequently and consequently the engine operation is adversely affected. Furthermore the combustion in a conventional internal combustion engine is almost similar to the constant-volume combustion so that the extreme high combustion temperature results and toxic $NO_x$ are produced. As a result, the pollution problem arises and the uneconomical consumption of fuel results.

Meanwhile in the conventional gas turbines the continuous combustion proceeds so that the emission of pollutants may be relatively minimized. However, the attempts for improving the thermal efficiency by increasing the compression ratio have been limited due to the heat-resistance of materials. Another attempt for improving the thermal efficiency by preheating the air by the heat of the exhaust gases results in the increase in size of a heat-exchanger. Furthermore as the automotive engines the conventional gas turbines cannot sufficiently respond to the rapid variations in speed and torque and require the transmissions which are too large in size.

The conventional constant combustion engines have the advantages in that the emission of pollutants may be minimized and that a wide variety of fuels may be used. However they have a defect that the temperatures of the combustion products to be charged into the engines are too high, adversely affecting the smooth operation of the engines.

SUMMARY OF THE INVENTION

The primary object of the present invention is therefore to provide a constant combustion engine which may substantially overcome the above and other problems encountered in the conventional engines.

The constant combustion engine in accordance with the present invention comprises in general means for supplying a predetermined quantity of air, means for supplying a predetermined quantity of fuel, means for supplying a predetermined quantity of water, a combustion device in which said predetermined quantity of air and said predetermined quantity of fuel are supplied from said air supply means and said fuel supply means, respectively, to be mixed, ignited and burned therein, thereby producing the combustion products, a vaporization device in which said combustion products are charged from said combustion device and said predetermined quantity of water is supplied from said water supply means to be sprayed into said combustion products, thereby producing the mixture of the combustion products and the water vapor, and a prime mover which is driven by said mixture of the combustion products and the water vapor supplied from said vaporization device.

According to one preferred embodiment of the present invention, the prime mover is a piston motor having one or more cylinders and a piston which is fitted into the cylinder for reciprocal movement, thereby defining a working chamber which is alternately compressed and expanded. The air supplied from said air supply means is charged into the working chamber and is compressed during the compression stroke, and the compressed air is charged into the combustion device. The compressed air from the working chamber and fuel from the fuel supply means are mixed and burned in the combustion device to produce combustion products. The combustion products is charged into the vaporization device and a predetermined quantity of water is injected into the combustion product in the vaporization device, thereby producing a mixture of the combustion products and the water vapor. The mixture of the combustion products and the water vapor is charged into the working chamber in the expansion stroke, whereby the piston is driven.

Therefore the effective charging of the compressed air into the combustion chamber and the effective discharge of the combustion products therefrom may be ensured. In like manner, the effective charging of the mixture of the combustion products and the water vapor into the cylinder and the effective discharge of the exhaust gases therefrom may be ensured. Furthermore the air and the fuel; the combustion products and the water; and the mixture of the combustion products and the water vapor are supplied in controlled quantities to the combustion chamber; the vaporization chamber and the cylinders in the prime mover. The water is injected or sprayed into the combustion products in the vaporization chamber so that the mixture of the combustion products and the water vapor may be produced as working gases. As a result, the temperature of the working gases to be charged into the cylinders may be lowered. In addition, the quantity of the working gases may be increased so that the output of the engine may be considerably increased; the various efficiencies of the engine may be remarkably improved; and the fuel consumption may be greatly reduced.

Furthermore the constant combustion engine in accordance with the present invention is very simple in construction and is best adapted for use as an automotive engine which must vary its output rapidly in response to the travelling conditions. Moreover the constant combustion engines in accordance with the present invention may be mass produced by the existing engine production lines. In addition, the emission of toxic gases such as HC, CO and $NO_x$ may be minimized. The constant combustion engine in accordance with the present invention may eliminate the use of the electric arc ignition device in the normal operation so that the radio interference problem may be eliminated, the smooth operation may be ensured and the noise and vibration problem may be overcomed.

The above and other objects, features and advantages of the present invention will become more apparent from the following description of preferred embodiments thereof taken in conjunction with the accompanying drawings.

BRIEF DESCRIPTION OF THE DRAWINGS

FIG. 11 is a diagram of a water supply system;

FIG. 12 is a graph illustrating the relationship between the quantity of water to be returned by a water shunt device in the water supply system and the engine speed;

Same reference numerals are used to designate similar parts throughout figures.

DESCRIPTION OF THE PREFERRED EMBODIMENTS:

First Embodiment, FIGS. 1–14

Figure 1:
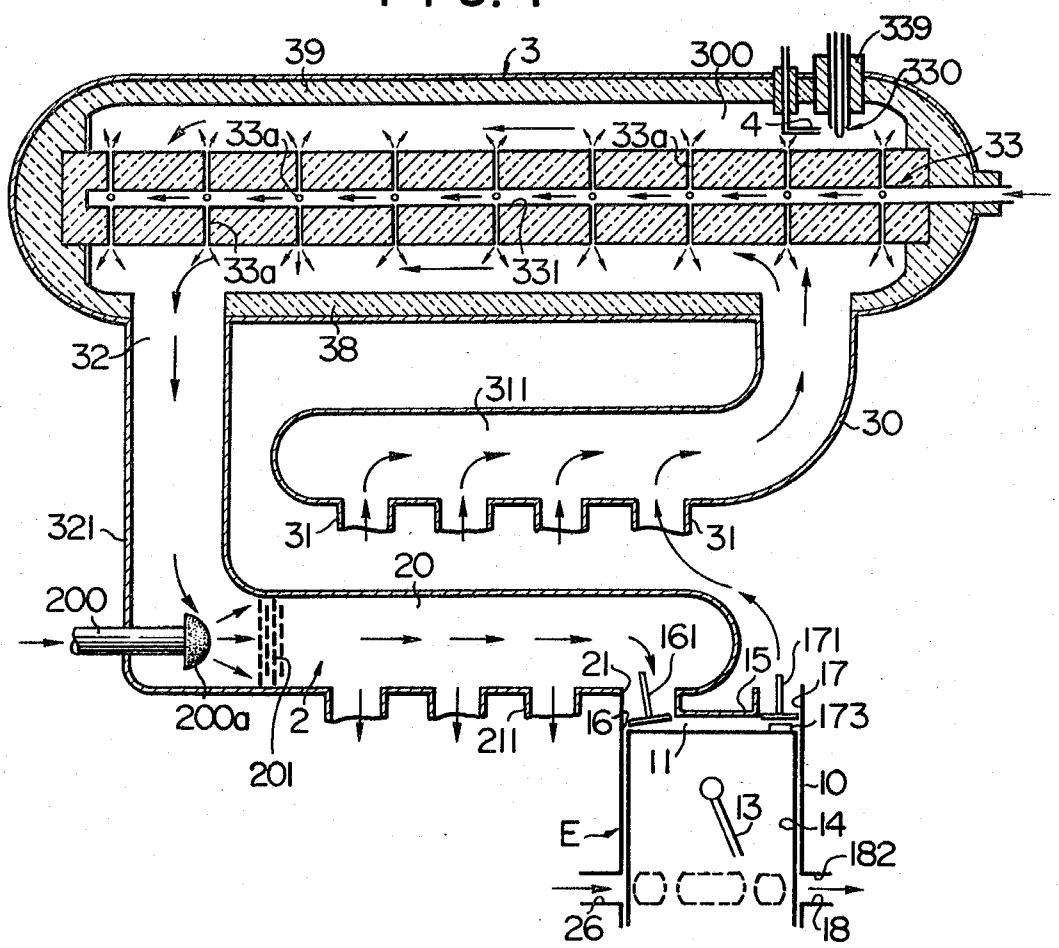
FIG. 1 is a schematic sectional view of a first embodiment of a constant combustion engine in accordance with the present invention.
Figure 2:
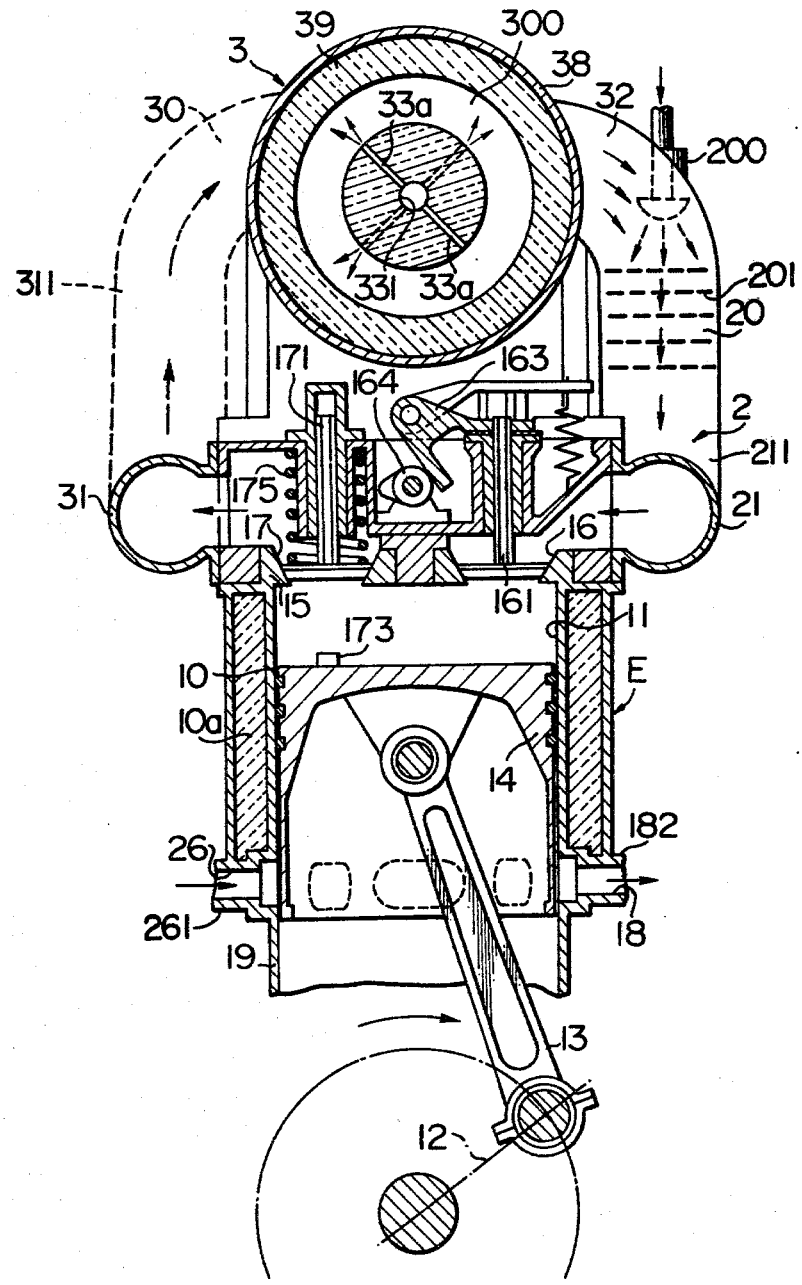
FIG. 2 is a sectional view thereof when viewed from the front, illustrating in detail an engine and a combustion device.

In general, a first embodiment of a constant combustion engine in accordance with the present invention comprises an two-cycle engine E or a prime mover which is a fluid motor of the positive displacement type, a vaporization device 2 and a combustion device 3. In FIGS. 1 and 2 the two-cycle engine E is shown as having only one cylinder for the sake of simplicity and as comprising a cylinder block 10 and a cylinder head 15. The cylinder block 10 has a cylinder 11 into which is reciprocably fitted a piston 14 which is connected through a connecting rod 13 to a crankshaft 12. The cylinder 11 is covered with a heat insulating member 10a or any other suitable heat insulating means.

The cylinder 11 is provided with four intake and exhaust ports; that is, a first intake port 26 for admitting the intake air into the cylinder 11, a first exhaust port 17 for charging into a combustion chamber 300 in a combustion device 3 the air which has been compressed in the cylinder 11, a second intake port 16 for admitting into the cylinder 11 mixture of combustion products and the water vapor supplied from a vaporization chamber 20 in the vaporization device 2 and a second exhaust port 18 for discharging outside a mixture of combustion products and the water vapor which has been expanded in the cylinder 11. The second intake port 16 provided at the cylinder head 15 is opened and closed by a second intake valve 161 while the first exhaust port 17 provided at the cylinder head 15 is opened and closed by a first exhaust valve 171.

The second intake port 16 is air-tightly communicated with a combustion products-water vapor mixture supply passage 211 of the vaporization device 2. The passage 211 has a discharge port 21 for discharging the mixture of combustion products and water vapor into the cylinder through the second intake valve 161. While the first exhaust port 17 is air-tightly communicated with a compressed air supply passage 311 of the combustion device 3. The passage 311 has a compressed air intake port 31 for charging the compressed air at one end thereof and also has a conduit 30 at the other end thereof. The compressed air from the cylinder is delivered to the combustion device 3 through the first exhaust port 17, the compressed air intake port 31, the passage 311 and the conduit 30, by opening the first exhaust valve 171.

Figure 13:
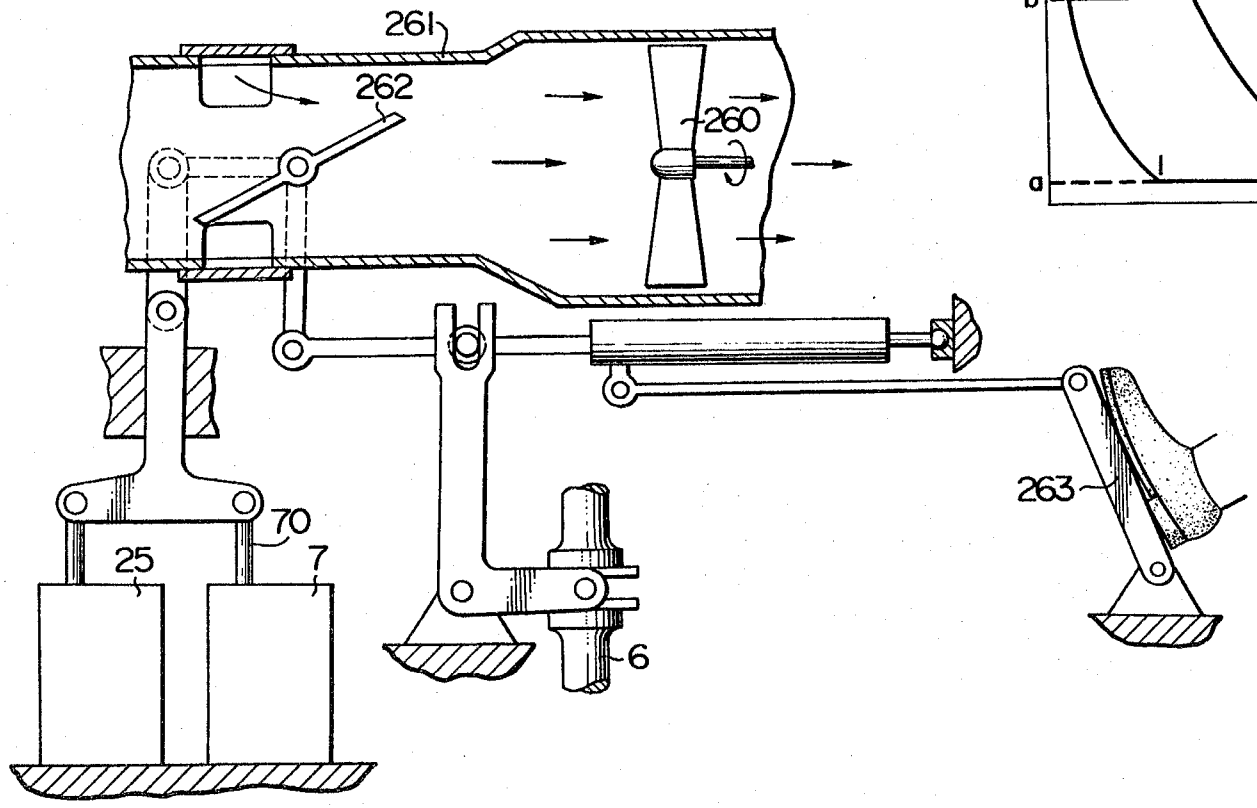
FIG. 13 shows the connection between the throttle valve and the fuel and water shunt devices and when the constant combustion engine as shown in FIGS. 1 and 2 is used as an automotive engine.

The first intake port 26 and the second exhaust port 18 are opened and closed as the piston 14 is reciprocated. As best shown in FIG. 13, the first intake port 26 is communicated with an intake air supply passage 261 into which are placed a throttle valve 262 which is operatively connected to an acceleration pedal 263 for controlling the flow rate of the intake air to be supplied into the first intake port 26 and a blower 260 which in turn is drivingly coupled to the crankshaft 12 of the engine E.

Referring back fo FIGS. 1 and 2, the second exhaust port 18 is communicated with an exhaust gas discharge passage 182 for discharging outside the mixture of combustion products and the water vapor after the mixture has been expanded in the cylinder 11.

A valve driving means comprising a rocker arm 163 and a camshaft 164 is provided on the cylinder head 15. The camshaft 164 carries a plurality of cams equal in number to the cylinders of the engine E and is drivingly coupled to the crankshaft 12 through a gear or chain power transmission mechanism (not shown) in such a way that the camshaft 164 makes one rotation as the crankshaft 12 makes one rotation. The cam carried by the camshaft 164 for rotation in unison therewith drives a rocker arm 163 in such a way that when the piston 14 approaches its top dead point the second intake valve 161 may be opened to thereby admit a predetermined quantity of the mixture of combustion products and the water vapor into the cylinder 11.

A first exhaust valve lifter 173 is extended upward from the top of the piston 14 opposed to the first exhaust valve 171 so that as the piston 14 approaches a predetermined point adjacent to its top dead point the first exhaust valve lifter 173 lifts the first exhaust valve 171 against the force of a spring 175, thereby admitting the compressed air into the combustion device 3. Furthermore it should be noted that when the pressure of the compressed air in the cylinder 11 overcomes the force of the spring 175 the first exhaust valve 171 is caused to open as well.

Figure 3:
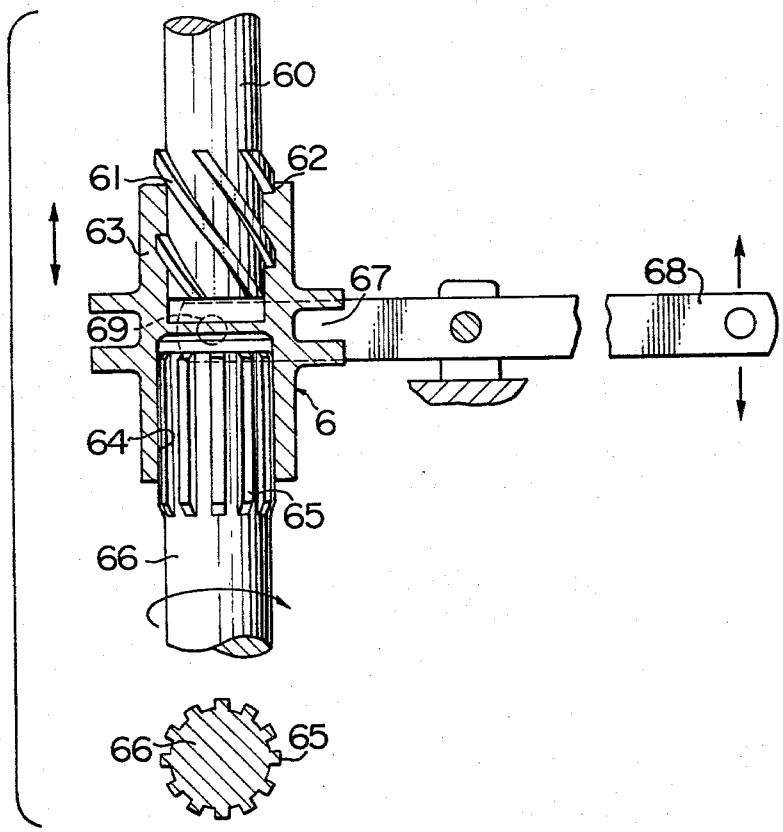
FIG. 3 is a view, partly in section and on enlarged scale, of a variable cutoff control device for controlling the timing of opening of an intake valve.

Referring to FIG. 3, the camshaft 164 is connected to the crankshaft 12 through a variable cutoff control device generally indicated by the reference numeral 6 which controls the timing of opening and closing of the second intake valve 161, whereby the quantity of the mixture of combustion products and the water vapor to be admitted into the cylinder 11 may be suitably varied as will be described in detail hereinafter.

Still referring to FIG. 3, the variable cutoff control device 6 comprises, in general, an upper shaft 60 which is coaxial with and drivingly coupled to the camshaft 164 for rotation in unison therewith, a lower shaft 66 which is drivingly coupled to the crankshaft 12 and a connecting hub 63 having an upper bore and a lower bore fitted over the upper and lower shafts 60 and 66, respectively. The upper shaft 60 is coupled to the connecting hub 63 through a plurality of helical ridges 61 integrally formed on the upper shaft 60 and fitted into the corresponding helical grooves 62 formed in the inner wall of the upper bore of the hub 63. Therefore upon rotation of the connecting hub 63 the upper shaft 60 is caused to rotate. The lower shaft 66 is splined to the connecting hub 63. That is, as well known in the art, the external part or straight ridges 65 of the lower shaft 66 is fitted into the corresponding internal part or straight grooves 64 formed in the interior wall of the bore of the connecting hub 63 so that the connecting hub 63 is caused to rotate in unison with the lower shaft 66.

The connecting hub 63 is further formed with upper and lower flanges extended radially outwardly substantially from the midpoints between the ends so as to define an annular guide groove 67. A pin 69 is extended from one end of a control lever 68 and is fitted into the annular guide groove 67 so that when the other end is swung in the directions indicated by arrows, the connecting hub 63 is caused to move upward or downward along the lower shaft 66 and consequently the upper shaft 60 is rotated in either direction relative to the lower shaft 66. Since the upper shaft 60 is connected to the camshaft 164 while the lower shaft 66 is connected to the crankshaft 12, upon swinging in either direction of the control lever 68 the camshaft 164 is angularly advanced ahead or lagged behind the crankshaft 12. As a result the timing of the cam carried by the camshaft 164 for engaging with or disengaging from the rocker arm 163 may be varied so that the opening and closing timing of the second intake valve 161 may be varied; that is, advanced or lagged. Since the cylinder 11 has a stroke volume varied in synchronism with the rotation of the crankshaft 12, the quantity of the mixture of combustion products and the water vapor to be forced into the cylinder 11 may be varied by changing the timing of opening and closing of the second intake valve 161 with respect to the rotation of the crankshaft 12 in the manner described above. Thus the expansion ratio of the mixture in the engine E may be efficiently increased or decreased as needs demand so that the output of the engine E may be suitably varied. Moreover, in accordance with this control device 6 the engine E can be started or stopped in a simple manner by merely controlling the quantity of the mixture of combustion products and water vapor in the above-mentioned manner.

In summary, when the variable cutoff control device 6 is so operated as to delay the timing of closing of the second intake valve 161, the mixture of combustion products and the water vapor admitted into the cylinder 11 is increased in volume, whereby the engine output is increased. Conversely when the timing of closing of the second intake valve 161 is advanced, the quantity of the mixture to be admitted into the cylinder 11 is decreased, whereby the engine output is decreased accordingly.

Referring back to FIG. 1, the combustion device 3 is mounted adjacent to the engine E and is sufficiently heat-insulated. The combustion device 3 has a steel shell 38 which is provided with fins for dissipating heat and which defines a combustion chamber 300 lined with refractory layers 39. The first exhaust port 171 is communicated through a compressed air intake port 31 with the compressed air supply passage 311 whose outlet conduit 30 merges tangentially with the combustion chamber 300 at one end thereof. In like manner a combustion product supply passage 321 which interconnects between the combustion device 3 and the vaporization device 2 tangentially departs from the other ends 32 (a combustion product outlet port) of the combustion chamber 300. Therefore the compressed air tangentially flows into the combustion chamber 300, swirls therethrough and tangentially leaves therefrom whereby the atomization of the fuel, the mixture of the atomized fuel and the compressed air and the combustion of the air-fuel mixture may be much facilitated.

A cylindrical fuel injection nozzle 33 is extended through the combustion chamber 300 coaxially thereof from one end to the other end and is formed with a plurality of axially spaced apart circumferential rows of injection holes **33*a* which are extended radially and equiangularly spaced apart from each other. The fuel is injected through these injection holes 33*a* into the compressed air flowing through the combustion chamber 300 so that the fuel may be atomized, vaporized and sufficiently diffused into the compressed air. The cylindrical fuel injection nozzle 33 is made of a material which is heat resisting and permeable (for instance, a porous material) so that the fuel may permeate through the material of the nozzle 33** and may maintain corona flames on the exterior surfaces of the nozzle.

Disposed in the space within the combustion chamber 300 in opposed relationship with the opening of the outlet conduit 30 of the compressed air supply passage 311 is an ignition device 330 which is disclosed in U.S. Pat. No. 3,892,206, granted to the same inventor July 1, 1975. The fuel ignition device 330 serves to ignite the air-fuel mixture when the engine E is started, to keep the combustion under the normal operation condition and to re-ignite after the engine E has been stopped for a short period.

Figure 5:
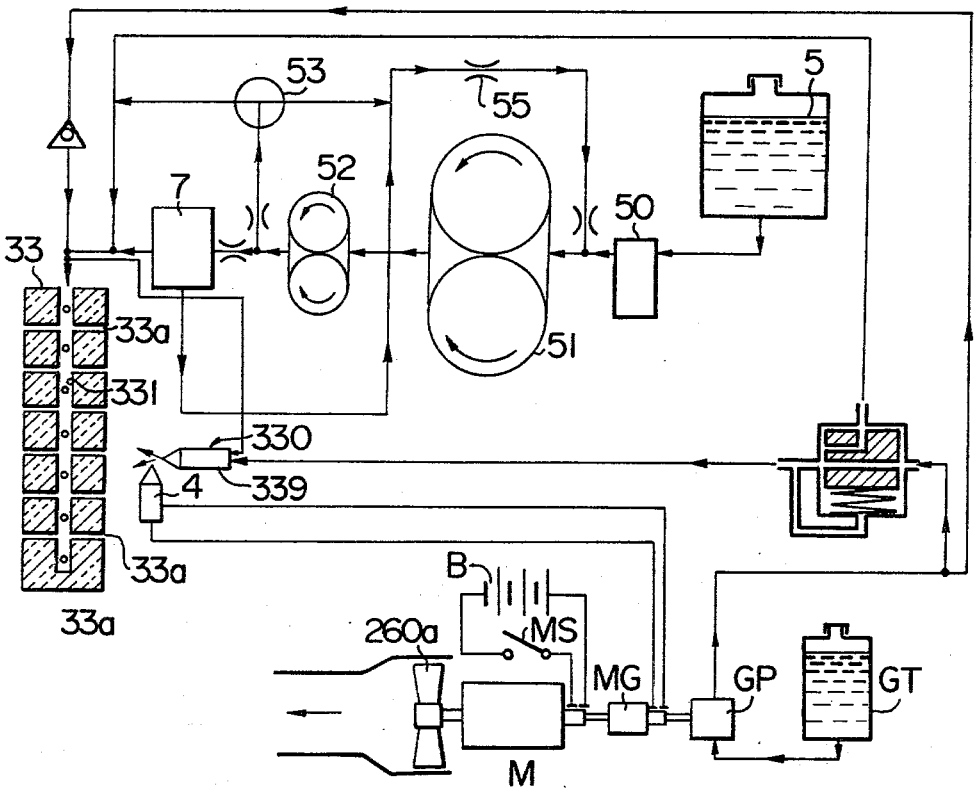
FIG. 5 is a diagram of a fuel supply system for supplying the fuel to the combustion device.

In order to supply the fuel injection nozzle 33 with the fuel, it is preferable to use a fuel supply system for internal combustion engine which is shown in FIG. 5 and disclosed in U.S. Pat. No. 4,029,070, granted to the same inventor June 14, 1977. The fuel in a fuel tank 5 is delivered by a diaphragm pump 50 to a governor pump 51 which in turn delivers the fuel to a fuel injection pump 52 which in turn delivers the fuel to the fuel injection nozzle 33 through a fuel shunt device 7. Both the governor and fuel injection pumps 51 and 52 are rotated at speeds in proportion to the engine speed. 1.5/2.5 of the fuel discharged from the governor pump 51 is delivered to the fuel injection pump 52 while the remaining 1/2.5 of the fuel is returned to the suction port of the governor pump 51 through a governor nozzle 55 whose flow resistance is set equal to that of the fuel injection nozzle 33. Then the pressure of the fuel at the inlet to the governor nozzle 55 becomes equal to the pressure of the fuel at the inlet to the fuel injection nozzle 33 so that the pressure drop across the fuel injection pump 52 is almost zero. That is, the pressure at the suction port of the fuel is substantially equal to the pressure at the discharge port. As a result the leakage of the fuel from the discharge side to the suction side of the fuel injection pump 52 may be substantially eliminated, whereby the quantity of the fuel discharged from the fuel injection pump 52 is in correct proportion with the engine speed. In order to deliver 1.5/2.5 of the fuel to the fuel injection pump 52, it is preferable to employ gear pumps as both the governor pump 51 and the fuel injection pumps 52 which have the gears having the same diameter but having the ratio of 2.5 : 1.5 between the length (in the axial direction).

1/2.5 of the fuel discharged from the fuel injection pump 52 (which is equal to 1.5/2.5 of the fuel discharged from the governor pump 51) is delivered to the shunt device 7 while the remaining 0.5/2.5 is delivered to a fuel shunt ratio control valve 53. For this purpose, the ratio between the intake port areas of the fuel shunt device 7 and the fuel shunt control valve 53 is determined to 1 : 0.5.

Figure 6:
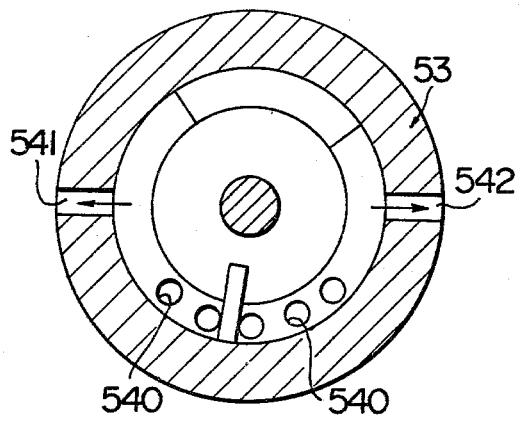
FIG. 6 is a front sectional view of a fuel shunt ratio control valve in the fuel supply system taken along the line VI—VI in FIG. 7.
Figure 7:
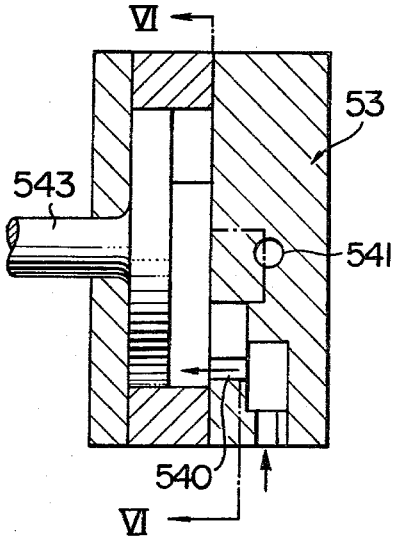
FIG. 7 is a side sectional view thereof.

In FIGS. 6 and 7 the construction of the fuel shunt control valve 53 is shown in detail. The control valve 53 has a plurality of intake ports 540 communicated with the fuel injection pump 52, two outlet ports 541 and 542 and a control rod 543 connected to a fuel shunt disk which divides the intake ports 540 into a first group in communication with the first outlet port 541 and a second group in communication with the second outlet 542 depending upon the angular position of the control rod 543. In the normal operation, all of the 0.5/2.5 fuel from the fuel injection pump 52 is returned to the suction port of the governor pump 51, but when an air-fuel ratio richer than an optimum ratio is desired, the control rod 543 is so rotated that a desired quantity of the fuel may be shunted and additionally delivered to the outlet port of the fuel shunt device 7. When all of the fuel delivered to the control valve 53 is in turn delivered to the outlet port of the fuel shunt device 7, the air-fuel ratio is increased almost equal to the stoichiometric ratio.

As described in detail in the above U.S. Pat. No. 4,029,070, of the fuel delivered from the governor pump 51 the fuel shunt device 7 delivers the fuel to the fuel injection nozzle 33 only in a quantity in correct proportion with the intake air quantity and returns the remaining fuel to the suction port of the governor pump 51.

Figure 8:
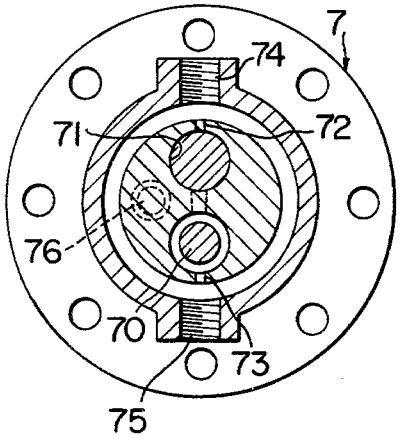
FIG. 8 is a cross sectional view of a fuel shunt device in the fuel supply system taken along the line VIII—VIII in FIG. 9.
Figure 9:
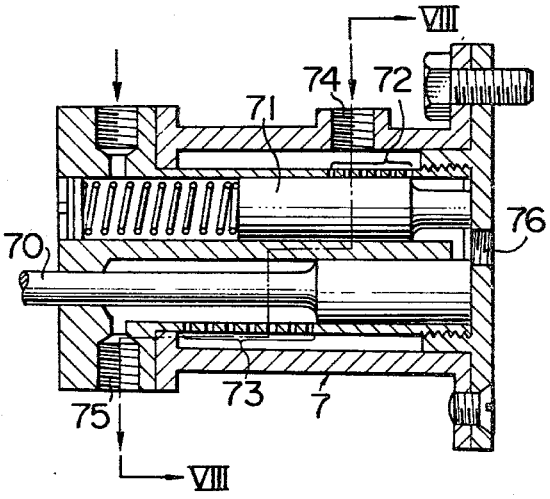
FIG. 9 is a longitudinal sectional view thereof.

In FIGS. 8 and 9 there is shown the construction of the fuel shunt device 7. A part of the fuel delivered from the fuel injection pump 52 through an intake port 74 passes through a predetermined number of metering holes 72 and flows into the fuel injection nozzle 33 through a delivery port 76 while the remaining fuel is returned to the governor pump 51 through a predetermined number of return holes 73 and a discharge port 75. More particularly, a control piston 71 is displaced in response to the pressure of the fuel at the intake port 74 (the quantity of the fuel delivered to the intake port 74 being in proportion to the engine speed) and opens a predetermined number of metering holes 72, whereby the quantity of the fuel supplied to the fuel injection nozzle 33 from the delivery port 76 may be made in correct proportion with the engine speed.

Figure 10:
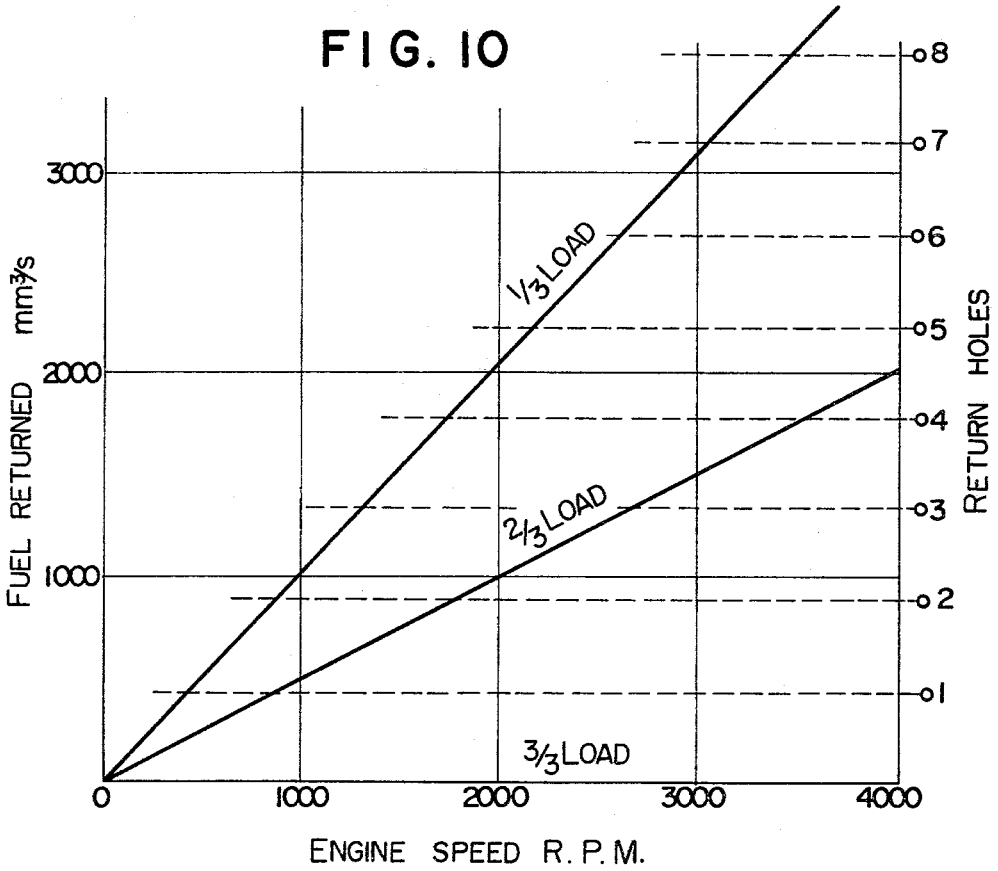
FIG. 10 is a graph illustrating the relationship between the quantity of fuel to be returned by the fuel shunt device shown in FIGS. 8 and 9 and the engine speed.

An acceleration piston 70 which is operatively connected to the throttle valve 262 (See FIG. 13) which controls the intake air admitted into the cylinder 11 is displaced and controls the number of return holes 73 which are opened. Thus the quantity of the fuel passing the return holes 73 is dependent upon the fuel injection pressure at the delivery port 76 and the number of return holes 73 which are opened. That is, the quantity of the fuel returned to the suction port of the governor pump 51 is in proportion to the engine speed and the output of the engine E as shown in FIG. 10. Thus with the use of the fuel supply system of the type described above, an optimum air-fuel ratio may be always maintained regardless of the engine speed and the load.

Referring back again to FIG. 1, the vaporization device 2 which is connected between the combustion device 3 and the engine E has an air tight cylindrical vaporization chamber 20 covered with refractory layers. Combustion products are charged from the combustion device 3 through the combustion products supply passage 321 which is designed air tight and to permit the smooth flow of combustion products therethrough. A water spray valve 200, which is water supply means, is extended through the wall of the vaporization chamber 20 in such a way that the water may be efficiently sprayed and diffused into the combustion products charged into the vaporization chamber 20 from the passage 321. More particularly the water spray valve 200 is provided with a semispherical water spray nozzle formed with a plurality of nozzle holes **200*a* so that the sprayed water may be sufficiently atomized and diffused into the combustion products. If required, a plurality of gratings 201 may be disposed downstream of the water spray valve 200** and spaced apart therefrom by a suitable distance so that the vaporization of the sprayed water may be facilitated.

In order to supply water to the water spray valve 200, a water supply system shown in FIG. 11 is preferably used which is substantially similar in construction to the fuel supply system described hereinbefore with particular reference to FIG. 5. First water in a water tank WT is pumped by a diaphragm pump 50W into a radiator 22, and a governor pump 23, a water injection pump 24, a water shunt device 25, a water shunt ratio control valve 27 and a governor nozzle 29 are employed in order to supply the water spray valve 200 with a predetermined quantity of water except when the engine is started. More particularly, the water content in the exhaust gases discharged from the engine E through the second exhaust port 18 is condensed in the radiator 22. Water in the radiator 22 is pumped by the governor pump 23 and is delivered to the water injection pump 24. Of the total quantity of water discharged from the governor pump 23, 1.5/2.5 is delivered to the water injection pump 24 while the remaining 1/2.5 is returned through the governor nozzle 29 to the suction port of the governor pump 23. Of the water discharged from the water injection pump 24, the water in quantity equivalent to 1/2.5 is delivered to the water shunt device 25 while the remaining water (equivalent to 0.5/2.5) is delivered to the water shunt ratio control valve 27 which in turn shunts the water to the discharge port of the water shunt device 25 and to the governor nozzle 29.

As with the corresponding pumps in the fuel supply system shown in FIG. 5 the governor pump 23 and the water injection pump 24 are gear pumps so that the water may be supplied to the water shunt device 25 in quantity in correct proportion with the engine speed. The water shunt device 25 is substantially similar in construction to the fuel shunt device 7 shown in FIGS. 8 and 9 except that the diameters of the metering and return holes 72 and 73 are different. That is, the water is supplied to the water shunt device 25 in a quantity 9 to 16 times as much as the fuel supplied to the fuel shunt device 7 so that the diameter of the metering and return holes of the water shunt device 25 is 9 to 16 times as large as the diameter of the metering and return holes of the fuel shunt device 7. Thus as with the fuel supply system shown in FIG. 5, the water supply system may supply the water spray valve 200 with water in a quantity in correct proportion with the air intake quantity regardless of the engine speed and the load.

The water shunt ratio control valve 27 is also similar in construction to the fuel shunt control valve 53 shown in FIGS. 6 and 7 and is so operated as to deliver the water to the water injection valve 200 in a desired quantity in addition to the water delivered from the water shunt device 25 when it is desired to increase the ratio of water beyond a predetermined ratio. Thus, the output of engine may be also increased to a maximum value by controlling the quantity of water to be delivered to the water supply valve 200 with this water shunt ratio control valve 27.

FIG. 12 shows the relationship between the quantity of water returned to the governor pump 23 and the engine speed in rpm with the load as a parameter. The characteristic curves shown in FIG. 12 are substantially similar to those shown in FIG. 10.

Next the mode of operation of the first embodiment with the above construction will be described. First referring to FIG. 5, a driver closes a starter switch MS to energize a starter motor M to drive the crankshaft 12. Then a small-sized gasoline pump GP is driven to pump gasoline from a gasoline tank GT and to inject it to a fuel injection nozzle 339 of the fuel ignition device or the flameholder 330 for starting the engine. Simultaneously the gasoline is injected through the injection holes 33*a* of the fuel injection nozzle 33 through a line bypassing the fuel supply system. The air-fuel mixture discharged from the flameholder 330 is ignited by an electric ignition plug 4 of the ignition device 330, which plug may be energized either by a magnet-ignition system MG or a transistor ignition system. The use of gasoline may shorten the starting time. Once the engine is started, the gasoline injection from the fuel injection nozzle 33 and the fuel ignition device 330 is automatically switched to the injection of a low grade fuel supplied from the fuel tank 5 through the fuel injection system described above.

Referring particularly to FIG. 2, when the piston 14 is displaced downward past the first intake port 26, the air flows from the intake air supply passage 261 (See FIG. 13) into the cylinder 11. During the upward stroke of the piston 14, it closes the first intake port 26 and subsequently the air charged into the cylinder 11 is compressed. Immediately before the piston 14 reaches the top dead point, the first exhaust port 17 is opened so that the compressed air is charged through the compressed air supply passage 31 into the combustion chamber 300 in the combustion device 3. When the down stroke of the piston 14 is started, the second intake valve 161 is opened so that the mixture of combustion products and the steam is charged into the cylinder 11 from the vaporization chamber 20 in the vaporization device 2 through the mixture supply passage 211. Until the second intake valve 161 is closed, work is done by the isobaric expansion of the mixture of combustion products and the water vapor, and then work is down by the polytropic expansion of the mixture of gases from the time when the second intake valve 161 is closed to the time when the piston 14 reaches near the bottom dead point at which the second exhaust port 18 is uncovered and consequently the mixture of gases is discharged from the cylinder through the second exhaust port 18.

The piston 14 makes one reciprocation for each rotation of the crankshaft 12, whereby one cycle of suction, compression, expansion and exhaust may be accomplished.

In one modification of the first embodiment, another port may be formed through the cylinder wall 11 and spaced downward apart from the first intake port 26 by a distance longer than the length of the piston 14 and a crankshaft chamber 19 may be arranged to be communicated through the other port with both the intake air supply passage 261 and the first intake port 26. According to such arrangement, during the upward stroke of the piston 14, the air is charged into the crank chamber 19 from the intake air supply passage 261 and during the downward stroke of the piston 14 the air charged into the crank chamber 19 is compressed and charged through the first intake port 26 into the chamber above the piston 14 in the cylinder 11. Thus the air to be supplied to the combustion chamber 300 may be compressed in two stages.

The compressed air charged into the combustion chamber 300 flows helically and is mixed with the fuel injected from the fuel injection nozzle 33 for use of driving the engine. The air-fuel mixture is ignited and burned and the combustion products are charged into the vaporization chamber 20 in the manner described above. The process wherein the impacts are given to the combustion chamber 300 by the variations in pressure after combustion so that the combustion may be much facilitated is not observed in the conventional gas turbines or boilers. Furthermore the combustion chamber 300 is lined with the refractory and reflecting layers so that the positive evaporation, ignition and combustion of the liquid fuel may be ensured. As described elsewhere, the plurality of circumferential rows of injection holes 33*a* are provided to effect the atomization and diffusion of the liquid fuel, and the injection holes 33*a* are defined by the heat-resisting and porous material so that the fuel always oozes out of the walls of the fuel injection nozzle 33 and is burned on the exterior surface of the nozzle 33 like the solar corona of the Sun at the eclipse. Therefore the positive ignition of the combustion mixture may be ensured so that even when the engine brake is applied a weak combustion may be maintained and the misfiring may be avoided even at the leanest air-fuel ratio. Thus the engine may be quickly turned from braking to power driving.

As described elsewhere the fuel ignition device 330 burns gasoline when the engine is started and is automatically changed to burn the low grade liquid fuel supplied from the fuel tank 5 once the normal combustion is started. Because of the provision of the fuel injection nozzle 33 having a plurality of spaced apart circular injection hole rows each consisting of a plurality of radially directed injection holes 33*a* so that the liquid fuel may be sprayed and diffused into a large space, due to the capability of the fuel injection nozzle 33 of maintaining the corona-like flames on the surface thereof and due to the provision of the fuel ignition device or the flameholder 330 which may ensure the positive ignition of the air-fuel mixture, the ignition when the engine is started or is operating under the low load condition may be ensured, and the misfiring which tends to occur after the application of the engine brake may be avoided. Thus the engine may respond to various operating conditions.

Figure 4:
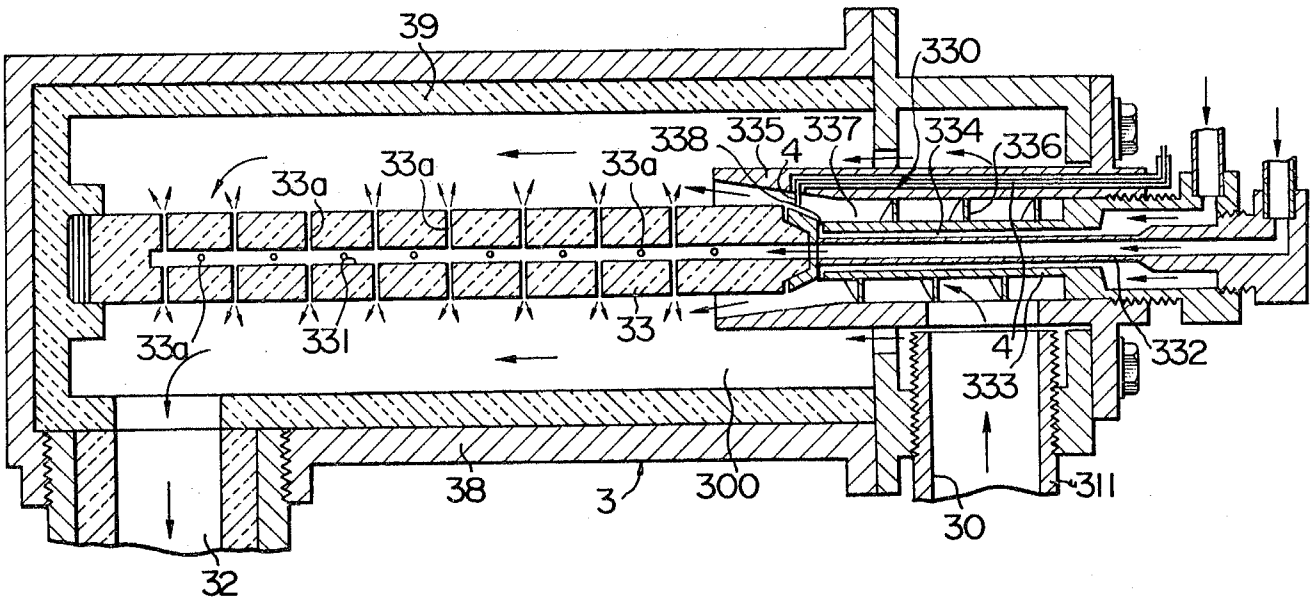
FIG. 4 is a sectional view of a modification of the combustion device shown in FIGS. 1 and 2.

Modification of Combustion Device, FIG. 4

FIG. 4 shows a modification of the combustion device 3 of the engine as shown in FIG. 1. The upstream end of the fuel injection nozzle 33 is connected to one end of a double wall tube consisting of an inner tube 332 and an outer tube 333. The inner tube 332 is communicated with the fuel supply passage 331 extended through the fuel injection nozzle 33 coaxially thereof so that the fuel may be supplied to the injection holes 33*a*. The annular space between the inner and outer tubes 332 and 333 serves as a fuel supply passage 334 (a fuel injection nozzle for use of starting the engine) of the fuel ignition device or the flameholder 330.

The outer tube 333 is surrounded by a cylinder 335 coaxially thereof, and a space between them serves an air swirling passage 337 in which are placed air swirling blades 336. The compressed air supply passage 311 is not only communicated with this air swirling passage 337 but also directly communicated with the combustion chamber 300 through the space surrounding the cylinder 335.

The fuel supply passage 334 of the flameholder or the fuel ignition device 330 is communicated with the air swirling passage 337 through radial holes 338 formed through the outer tube 333 adjacent to the joint between the fuel injection nozzle 33 and the double wall tube (332 and 333). The radial holes 338 are fitted with wicks so that when the engine is started the gasoline supplied through the fuel supply passage 334 oozes through the wicks to the exterior surface of the outer tube 333 and may be ignited by the sparks generated by the electric spark plug 4 extended through the cylinder 335 and disposed in nearly opposed relationship with the radial hole 338. As described elsewhere when the normal combustion is once started the supply of the fuel to the wicks in the radial holes 338 is automatically switched from the gasoline to the low grade liquid fuel, and the flames may be maintained without the use of the electric spark plug 4 and may positively ignite the air-fuel mixture in the combustion chamber 300. Since the air swirls through the swirling passage 337 in this modification, the atomization, evaporation and diffusion of the fuel into the air may be much facilitated as compared with the first embodiment so that the more stable and efficient combustion may be ensured.

The combustion products thus produced in the combustion chamber 300 are charged into the vaporization chamber 20 of the vaporization device 2 and are mixed with the water injected in the manner described above. The injected water is immediately vaporized by the heat of the combustion products so that the temperatures of the combustion products are lowered. However, the total quantity of the mixture of combustion products and the water vapor is considerably increased due to the vaporization of the water so that the temperature drop may be sufficiently compensated.

In order to avoid the extreme temperature concentration at local areas, the combustion device 3 or the combustion chamber 300 is so arranged and constructed that heat may be distributed in a wide space. As a result the flame temperatures may be uniformly lowered, the partial pressure of oxygen may be lowered in the high temperature combustion zone and the combustion time may be shortened so that the emission of toxic gases especially $NO_x$ may be prevented.

The output of the engine E may be varied for the 3/3, 2/3 and 1/3 load operations. When the driver depresses the acceleration pedal 263 so that the acceleration piston 70 (see FIG. 9) is pulled out of the fuel shunt device 7 and closes more return holes 73, the fuel injection quantity is increased accordingly in the manner described above as shown in FIG. 10. That is, when the air-fuel ratio is richer than an optimum ratio, the torque of the output shaft is increased, but when the air-fuel ratio is leaner than the optimum ratio, the torque is decreased.

Next the thermal efficiency of the engine will be described. As described above, 9 kg of water is injected for one kilogram of fuel so that the temperature of the combustion products may be lowered by the evaporation of the water injected before the mixture of combustion products-water vapor is charged into the cylinder, whereby the operation of the engine E may be facilitated. Now assume that water be injected into the combustion products at 70 kg/cm$^2$ and be converted into the vapor at the same pressure. Then the required enthalpy is the difference 552.8 kcal/kg between the enthalpy 611.6 of vapor at 70 kg/cm$^2$ and the enthalpy 102.8 of water at 1.5 kg/cm$^2$. However since water is somewhat superheated, the difference enthalpy is assumed to be 600 kcal/kg. When 23.8 kg of the combustion products produced by the combustion of the mixture of the air-fuel ratio 22.8 : 1 is cooled by $\Delta$ T° C. by the injection of Gw kg of water at an isobaric specific heat Cp=0.3 kcal/kg, the following equation is established:

$$600\ Gw = 23.8 \times 0.3 \Delta T$$

When Gw=9,$\Delta$T=756° C.

The combustion temperature of 1,550° C. is dropped to $$1{,}550°\ C. - 756°\ C. = 794°\ C.$$

That is, the mixture of combustion products water vapor at 794° C. is charged into the cylinder 11. Since the specific volume v of the steam is 0.0804 m$^3$/kg, the vaporization of 9 kg of water results in the increase of 0.7236 m$^3$. Under the pressure of 70 kg/cm$^2$ and at a temperature T=273° C.+794° C.=1,067° K., 23.8 kg of the combustion gases has a volume of 1.1475 m$^3$ when a gas constant R=30. Then one kilogram of fuel yields 1.8771 m$^3$ of the working gas at 70 kg/cm$^2$ and 794° C.

Figure 14:
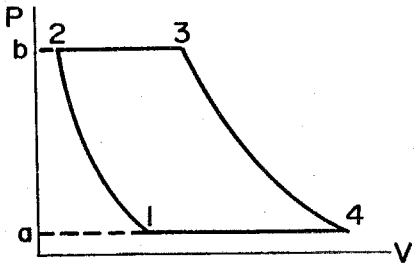
FIG. 14 is a pressure-volume diagram showing the cycle of the first embodiment.

FIG. 14 shows the cycle of the engine in accordance with the present invention in terms of the pressure-volume diagram wherein the air is charged into the cylinder 11 through the first intake port 26 at 1, during the stroke 1–2 the air is compressed, at 2 the compressed air is discharged through the first exhaust port 17, at 3 the mixture of combustion products-water vapor is charged into the cylinder 11 through the second intake port 16, during the stroke 3–4 the mixture gas expands and at 4 the mixture gas is exhausted through the second exhaust port 18. Let Ec and Ee denote the areas a12*b* and a43*b*, respectively, in FIG. 14. Then from the general relation between the change of state of and work done by a perfect gas $$En = \frac{Cp}{n} \cdot \frac{n}{k} \cdot \frac{k-1}{n-1} (T_1 - T_2),$$

The following relations are resulted:

$$Ec = \frac{Cp}{A} \cdot \frac{n}{k} \cdot \frac{k-1}{n-1} (T_1 - T_2) \cdot G_c$$

and $$Ee = \frac{Cp}{A} \cdot \frac{n}{k} \cdot \frac{k-1}{n-1} (T_3 - T_4) \cdot G_e$$

where

A=1/427, n and k=indexes in cases of the polytropic process and the adiabatic change, Cp=an isobaric specific heat, $G_c$=the weight of the gas compressed, $G_e$=the weight of the gas expanded, and $T_1$, $T_2$, $T_3$ and $T_4$=the absolute temperatures of the gas at the points 1, 2, 3 and 4, respectively.

Assuming that the indexes n and k have the same value, $$\frac{Ec}{Ee} = \frac{T_2 - T_1}{T_3 - T_4} \cdot \frac{G_c}{G_e} \cdot \frac{Cpc}{Cpe}$$

When $T_1$=288° K. and $T_3$=1067° K., $T_2$=971° K. and $T_4$=402° K. With one kilogram of the fuel, $G_c$=22.8 and Ge=32.8. Then $$\frac{Ec}{Ee} = \frac{683}{665} \cdot \frac{22.8}{32.8} \cdot \frac{0.240}{0.3068} = 0.5584$$

The work done in each cycle is $$\text{work} = Ee - Ec = (1 - Ec/Ed)Ee$$

Assuming $n=k$, $$\begin{aligned} Ee &= Cp/A\,(T_3 - T_4)\,Ge \\ &= 0.3068 \times 427 \times 665° \times 32.8 \\ &= 2857800 \text{ kg-m} \\ &= 6693 \text{ kcal.} \end{aligned}$$

Substituting Ee=6693 and Ec/Ee=0.5584 in the above equation we have $$\begin{aligned} \text{work done} &= 0.4416 \times 6693 \\ &= 2955.7 \text{ kcal.} \end{aligned}$$

The heat supplied is not equal to the heating value of 10700 kcal/kg of one kilogram of the fuel. Since the fuel is preheated to 698° C. due to the heat of compression prior to the combustion, it suffices to burn the fuel of $$(1550° - 698°) \div (1550° - 50°) = 1/1.8016 \text{ kg.}$$

Then the heat supplied is $$10700 \div 1.8016 = 5939 \text{ kcal, and}$$

the thermal efficiency $\eta_{th}$=2955.7/5939=0.4977. Assuming the efficiencies of the combustion system and the work system be 0.95, the actual thermal efficiency $\eta = 0.4977 \times 0.95^2 = 0.4492$.

The output of the engine E may be controlled by the acceleration pedal 263 and the air-fuel ratio control lever. That is, when the driver depresses the acceleration pedal 263, the output of the engine E is shifted stepwise to 2/3 and 1/3 from the full output 3/3 while the air-fuel ratio is maintained at an optimum ratio. When the driven operates the air-fuel ratio control lever, the air-fuel ratio becomes richer or leaner than the optimum ratio, whereby the output may be varied.

According to the present invention the combustion in the combustion chamber is effected at a constant pressure so that a maximum combustion temperature is limited. As a result, the thermal decomposition may be avoided so that the emission of $NO_x$ may be avoided. Furthermore the water is injected into the combustion products in the vaporization chamber in the vaporization device and thus the mixture of combustion products and water vapor may be produced so that the temperature of the working gas may be lowered and the working gas may be increased in volume. Since the working gas or the mixture of the combustion products and water vapor is sufficiently expanded within the cylinder near to the atmospheric pressure, the output of the engine may be considerably increased and may be smoothly varied according to the various operating conditions. Therefore as compared with the conventional engines, the thermal efficiency may be remarkably improved, the considerable reduction in fuel consumption may be achieved and the greater power may be generated from the engine compact in size and light in weight. Furthermore the engine may be simplified in construction and is best adapted for use as an engine of an automotive vehicle because better maneuravability is ensured. Moreover the engines in accordance with the present invention may be mass produced by the existing production lines. There is a further advantage that the use of leadless gasoline is not required and the inexpensive and relatively involatile low grade fuels such as those for diesel engines may be used. In addition, alcohol may be equally used.

The present invention further eliminates the use of the spark ignition during the normal operation so that the radio interference problem may be eliminated. Furthermore the smooth operation may be ensured, and since the exhaust gas pressure is low, noise as well as vibrations may be minimized.

Figure 15:
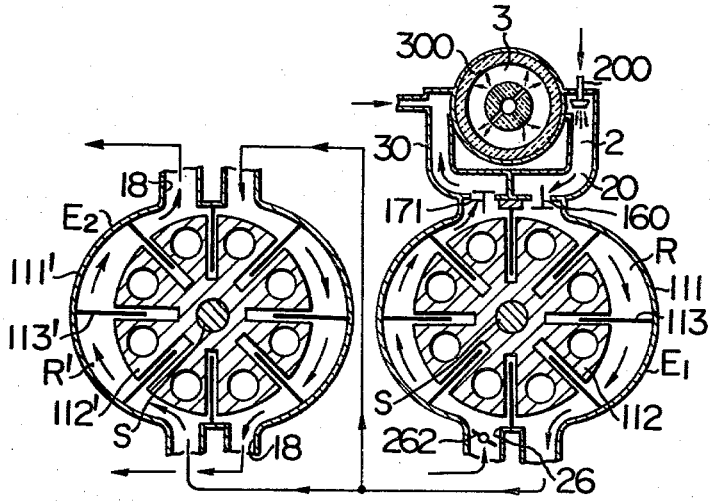
FIG. 15 is a sectional view of a second embodiment of the present invention wherein fluid motors of the vane type are used as prime movers.
Figure 16:
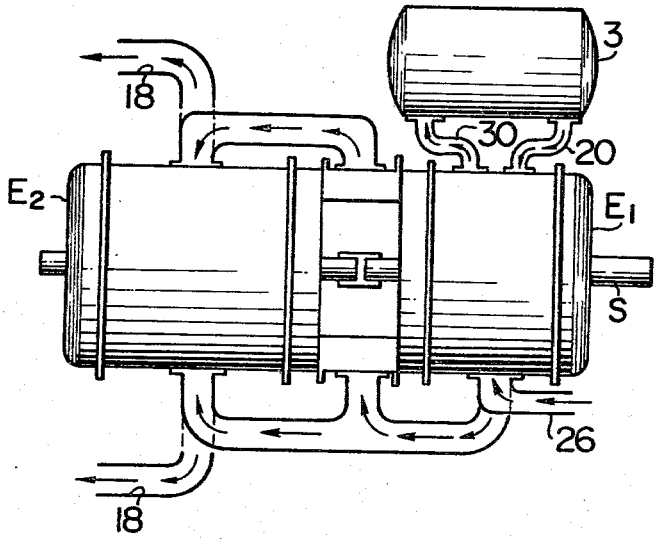
FIG. 16 is a side view thereof.

Second Embodiment, FIGS. 15 and 16

So far the present invention has been described as being applied to the reciprocal engine, but it will be understood that the present invention may be equally applied not only to the rotary engines but also the turbines.

In the second embodiment shown in FIGS. 15 and 16 the present invention is shown as being applied to a vane type rotary engine. Two vane type rotary engines $E_1$ and $E_2$ are disposed in tandem. That is, the rotors of the engines $E_1$ and $E_2$ are mounted on the same driving shaft S.

The engine $E_1$ comprises a casing 111 having a bore, and a rotor 112 carried by the driving shaft S for rotation within the casing bore and provided with a plurality of blades 113 in slots in the rotor 112. The outer ends of the blades 113 are maintained in contact with the casing bore so that small chambers R are defined between the blades 113 and the bore. Each of the small chambers R is caused to expand and contract for every half rotation of the shaft S or the rotor 112. When the small chamber R is communicated with the first intake port 26 into which is placed a throttle valve 262, the air is charged into the small chamber R, and as the rotor 112 is rotated in the direction indicated by the arrow, the air in the small chamber R is compressed and discharged through a first exhaust port 171 into the combustion chamber 300 of the combustion device 3 mounted on the first rotary engine $E_1$. As with the first embodiment described hereinbefore, the combustion products produced in the combustion chamber 300 are charged into the vaporization chamber 20 in the vaporization device 2 and are mixed with the water injected through the water injection nozzle 200 in the manner described. The mixture of the combustion products and water vapor is charged into the small chamber R through a second intake port 160 when the second intake valve 161 is opened. The mixure of combustion products and water vapor expands, thereby driving the rotor 112, is discharged out of the small chamber R and charged into the small chambers R′ in the second rotary engine $E_2$ as indicated by the arrows in FIG. 15.

The second rotary engine $E_2$ is substantially similar in construction to the first rotary engine $E_1$ and comprises a casing 111′, a rotor 112′ and vanes or blades 113′. The exhaust gases from the first rotary engine $E_1$ are divided into two flows and respective flows are charged into the top right and bottom left small chambers R′ of the second rotary engine $E_2$. The gases expand in these small chambers R′, thereby driving the rotor 112′ and are discharged through the second exhaust ports 18. That is, in the second embodiment, the mixture of combustion products and water vapor is expanded twice, whereby the most efficient use of the energy of the working gas may be ensured.

It is to be understood that the present invention is not limited to the preferred embodiments thereof described hereinbefore and that various modifications may be effected without departing the true spirit of the present invention.

What is claimed is:

1. A constant combustion engine comprising:

means for supplying a predetermined quantity of air;

a prime mover connected to said air supply means, which alternately repeats compression of said predetermined quantity of supplied air and expansion of a mixture as a working gas;

means for supplying a predetermined quantity of fuel;

a combustion device in which said compressed air and said predetermined quantity of fuel are supplied from said prime mover and said fuel supply means, respectively, to be mixed, ignited and burned therein, thereby producing the combustion products;

means for supplying a predetermined quantity of water provided at the downstream of said combustion device; and a vaporization device in which said combustion products are charged from said combustion device and said predetermined quantity of water is supplied from said water supply means to be sprayed into said combustion products, thereby producing the mixture of said combustion products and water vapor as said working gas;

said mixture of the combustion products and water vapor being supplied to said prime mover from said vaporization device and expanded therein to drive the prime mover.

2. A constant combustion engine as set forth in claim 1 wherein said prime mover is a fluid motor of the positive displacement type having a working chamber which is alternately expanded and contracted, said predetermined quantity of air is charged into said working chamber and is compressed during the compression stroke, and said mixture of said combustion products and said water vapor is charged into said working chamber in the expansion stroke, thereby driving said fluid motor.

3. A constant combustion engine as set forth in claim 2 wherein said fluid motor includes:

one or more cylinders;

a piston fitted into the cylinder for reciprocal movement, thereby defining said working chamber which is alternately compressed and expanded;

a first intake port which communicates with said working chamber to supply the air thereto when said piston reaches near the bottom dead point of its stroke;

a first exhaust or discharge port for communicating said working chamber with said combustion device when said piston reaches near the top dead point;

a second intake port for keeping the communication between said vaporization device and said working chamber from the time when said piston passes past said top dead point until the time when said piston reaches near the bottom dead point; and a second exhaust or discharge port for communicating said working chamber with outside when said piston reaches near the bottom dead point.

4. A constant combustion engine as set forth in claim 3 further including:

a valve for opening and closing said second intake port;

valve driving means which is responsive to the reciprocal movement of said piston for opening said valve; and control means operatively coupled to said valve driving means for controlling the timing of opening of said valve.

5. A constant combustion engine as set forth in claim 2 wherein said fluid motor is a vane type motor comprising a casing having an elliptical bore and a rotor which is disposed for rotation in said bore and which has a plurality of vanes which define working chambers which are compressed and expanded; and said casing has a first inlet port for communicating said air supply means with one of said working chambers, a first exhaust or outlet port for communicating the compressed working chamber with said combustion device, a second inlet port for communicating said vaporization device with one of said working chamber which is to be expanded and a second exhaust or outlet port for communicating one of said working chambers which is charged with said mixture of combustion products and said water vapor and is being compressed with the outside.

6. A constant combustion engine as set forth in claim 1 wherein said vaporization device includes a vaporization chamber having at its one end an inlet for being supplied with said combustion products from said combustion device and its other end at least one outlet for delivering the mixture of said combustion products and water vapor to said prime mover, a water spray valve disposed within said vaporization chamber in the vicinity of said inlet for injecting said predetermined quantity of water into said vaporization chamber and at least one grating across said vaporization chamber in opposed relation with said spray valve.

7. A constant combustion engine as set forth in claim 1 and for use as an automotive engine wherein said air supply means includes:

an intake air passage, a blower placed in said intake air passage for drawing the air into said intake air passage, and a throttle valve placed in said intake air passage and operatively coupled to an acceleration pedal for controlling the flow rate of the air flowing through said intake air passage;

said fuel supply means includes a means for controlling the quantity of fuel to be supplied in response to the engine speed and to the degree of opening defined by said throttle valve; and said water supply means includes a means for controlling the quantity of water to be supplied in response to the engine speed and to the degree of opening defined by said throttle valve.

8. A constant combustion engine as set forth in claim 1 and for use as an automotive engine wherein said combustion device and said vaporization device are mounted above said prime mover.

9. A constant combustion engine as set forth in claim 1 wherein said combustion device includes:

an elongated cylindrical combustion chamber having an air intake port adjacent to one end thereof and a combustion product outlet port adjacent to the other end thereof;

a fuel ignition device disposed within said combustion chamber adjacent to said one end thereof; and a fuel injection nozzle means disposed coaxially of said combustion chamber for injecting the fuel throughout said combustion chamber;

said fuel injection nozzle means including a cylindrical core body extended coaxially of said combustion chamber from said one end to said the other end thereof;

a fuel supply passage extended coaxially of said core body and communicated with said fuel supply means; and a plurality of spaced apart circumferential rows of radially directed nozzle holes which are communicated with said fuel supply passage.

10. A constant combustion engine as set forth in claim 9 wherein said combustion chamber is lined with heat-resisting and heat-reflecting walls, and said core body of said fuel injection nozzle means is made of a porous material.

* * * * *